US008104381B1

(12) United States Patent
Chen

(10) Patent No.: US 8,104,381 B1
(45) Date of Patent: Jan. 31, 2012

(54) UNIDIRECTIONAL RATCHET WRENCH

(76) Inventor: Yu-Tang Chen, Taichung (TW)

( * ) Notice: Subject to any disclaimer, the term of this patent is extended or adjusted under 35 U.S.C. 154(b) by 0 days.

(21) Appl. No.: 12/387,744

(22) Filed: May 8, 2009

(51) Int. Cl.
*B25B 13/46* (2006.01)

(52) U.S. Cl. ..... 81/63.2

(58) Field of Classification Search ..... 81/63.2, 81/60, 58
See application file for complete search history.

(56) References Cited

U.S. PATENT DOCUMENTS 5,636,557 A * 6/1997 Ma ..... 81/60
5,979,274 A * 11/1999 Hsieh ..... 81/60
6,862,955 B1 * 3/2005 Shu-Sui et al. ..... 81/60
7,100,477 B2 * 9/2006 Lee ..... 81/60
2006/0027049 A1 * 2/2006 Arnold ..... 81/60
* cited by examiner

*Primary Examiner* — David B Thomas

(57) ABSTRACT

A unidirectional ratchet wrench includes a body. The body has a first containing groove disposed at an action end of the body. A ratchet includes a sheathing portion formed thereof. A brake tooth is in an arc shape, and the brake tooth includes a plurality of latch teeth formed thereon for engaging with the engaging teeth of the ratchet. A control plate is contained in the arc-shaped second containing groove, and the control plate has the same height as the pressing edge of the body. An elastic element is contained in the accommodating groove of the brake tooth. A cover is installed in an upper cover groove of the body. A latch ring is latched to an circular latch groove of the body for fixing the cover onto the body.

4 Claims, 11 Drawing Sheets

A-A

UNIDIRECTIONAL RATCHET WRENCH

BACKGROUND OF THE INVENTION

1. Field of the Invention

The present invention relates to a unidirectional ratchet wrench integrally formed with a control plate by a sheet metal manufacturing process.

2. Description of the Related Art

With reference to FIG. 2 for a conventional ratchet wrench as disclosed in U.S. Pat. No. 7,100,477, the conventional ratchet wrench has the following shortcomings:

1. In the prior art as shown in FIG. 2, a metal sheet 21 is stamped into arc iron plates, and an inverted L-shaped bent rod 22 is manufactured and welded at an appropriate position, and a protruding rod 23 is welded from the bend rod 22, and a press plate 24 is welded from another end of the metal sheet 21, and thus the metal sheet 21 has to go through a complicated manufacturing procedure.

2. In the prior art as shown in FIG. 1, a front edge of the metal sheet 21 is coupled to ratchet teeth 31 of a ratchet 30, such that when the ratchet 30 is rotated in 360 degrees, the tip of each ratchet tooth 31 rubs with the front edge of the metal sheet 21, and the ratchet teeth 31 are worn out slightly. After the ratchet 30 has been worn, a unidirectional ratchet block 25 of the ratchet wrench is no longer engaged with the ratchet 30 properly, and the rotation torque becomes too weak. If an adhesive is used for fixing the metal sheet 21 into an arc embedded groove 15, then the metal sheet 21 will not rub with the ratchet teeth 31, but the foregoing structure fixed with the metal sheet 21 involves an additional manufacturing process.

3. In the prior art as shown in FIG. 4, the unidirectional ratchet block 25 has a hole 28 for containing an elastic element 29, but the unidirectional ratchet block 25 formed by casting powder cannot form the hole 28. The hole 28 is drilled, and such manufacture incurs a higher manufacturing cost.

Another conventional ratchet wrench as disclosed in U.S. Pat. No. 6,862,955 has the following shortcomings:

1. In the prior art as shown in FIG. 3, the positioning element 30 is in the same shape of the first containing groove 21 and the second containing groove 22 of the wrench body 20, and thus the positioning element 30 requires a higher cost.

2. In the prior art as shown in FIG. 5, the spring 34 is installed in the positioning portion 33 and abutted against a lateral side and a top surface 42 of a latch block 40, and thus the spring 34 is rubbed with the latch block 40 to cause a damage easily.

3. The positioning element 30 and the ratchet 50 are contained in the wrench body 20, and thus it is necessary to add the thickness of the positioning element 30 to the first containing groove 21, and thus the wrench body 20 is thicker than a general wrench.

SUMMARY OF THE INVENTION

A unidirectional ratchet wrench comprising: a body includes a first containing groove disposed at an action end of the body, a ratchet includes a sheathing portion at a central position of the ratchet, a brake tooth is an arc shaped block, and a distal surface of the brake tooth includes a plurality of latch teeth engaged with the engaging teeth of the ratchet, a control plate is contained in the corresponding arc second containing groove, and the control plate has the same height as the pressing edge of the body, an end of the elastic element is contained in the accommodating groove of the brake tooth, a cover is installed in the upper cover groove of the body, a latch ring is latched to the circular latch groove of the body and abutted against the concave circular groove of the cover for fixing the cover onto the body.

DETAILED DESCRIPTION OF THE PREFERRED EMBODIMENTS

Figure 1:
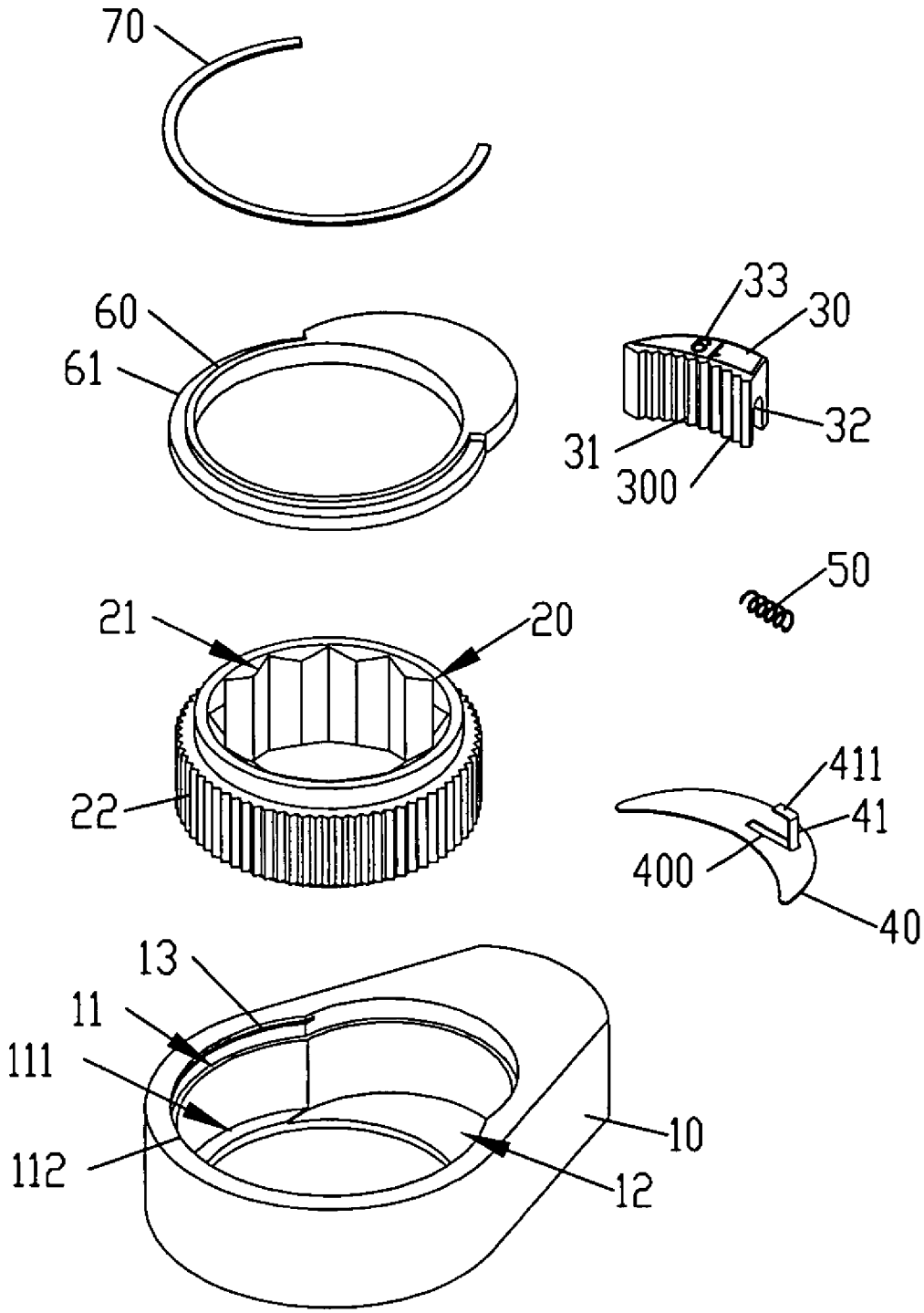
FIG. 1 shows an exploded view of the present invention.

In FIG. 1, a unidirectional ratchet wrench comprises: a body 10 which includes a first containing groove 11 disposed at an action end of the body 10, and a pressing edge 111 disposed on a bottom of the first containing groove 11 and having a smaller inner diameter than the first containing groove 11. The body 10 includes a second containing groove 12 disposed on the action end of the body 10 and communicating with the first containing groove 11, wherein a bottom of the second containing groove 12 has a relative lower position than the pressing edge 111 to constitute a height difference. The first containing groove 11 and the second containing groove 12 have an upper cover groove 112 defined in an upper portion of an inner periphery thereof. A circular latch groove 13 is disposed on an inner periphery of the upper cover groove 112.

A ratchet 20 is pivotally received in and coupled to the first containing groove 11 of the body 10 and includes a sheathing portion 21 formed at a center of the ratchet 20, and the sheathing portion 21 is hollow and has a series of tooth (not numbered) formed on an inner periphery thereof. The ratchet 20 includes a plurality of engaging teeth 22 disposed at an external periphery thereof.

A brake tooth 30 is contained in the second containing groove 12 of the body 10 and is in an arc shape corresponding to the second containing groove 12. The brake tooth 30 includes a plurality of latch teeth 31 formed on a lateral surface thereof for engaging with the engaging teeth 22 of the ratchet 20. The brake tooth 30 includes an accommodating groove 32 disposed at a bottom surface 300 of the brake tooth 30. The accommodating groove 32 extends to a lateral side of the brake tooth 30 to form an opening. The brake teeth 30 abut against a lateral side of the second containing groove 12, and the brake tooth 30 has a symbol 33 formed on a top thereof for identifying a size.

A control plate 40 is correspondingly contained in the arc-shaped second containing groove 12, and the control plate 40 has the same height as the pressing edge 111 of the body 10. The control plate 40 is made by a sheet metal. The control plate 40 has a pressing portion 41 and a horizontal portion 411 integrally formed thereon and configuring into an inverted L shape. The pressing portion 41 perpendicularly extends upwardly from the control plate 40. The horizontal portion 411 is connected to a free end of the pressing portion 41 and perpendicularly extends from the pressing portion 41. A through slot 400 is defined in the control plate 40 and formed on the control plate 40 by a sheet metal manufacturing process. The through slot 400 is adjacent to the pressing portion 41 and located under the horizontal portion 411. The horizontal portion 411 has the same height as the accommodating groove 32 of the brake tooth 30. The control plate 40 is installed between the bottom surface 300 of the brake tooth 30 and the second containing groove 12, and a front end of the control plate 40 is disposed between the engaging teeth 22 of the ratchet 20 and the first containing groove 11 of the body 10.

An elastic element 50 is disposed in the second containing groove 12. An end of the elastic element 50 is contained in the accommodating groove 32 of the brake tooth 30, and another end of the elastic element 50 is installed at the horizontal portion 411 of the control plate 40. The elastic element 50 is abutted between the brake tooth 30 and the pressing portion 41 of the control plate 40.

A cover 60 is installed in the upper cover groove 112 of the body 10 for positioning each component into the body 10. The cover 60 has an L-shaped cross section and includes a concave circular groove 61 annularly defined in an outer periphery of the cover 60.

A latch ring 70 is latched to the circular latch groove 13 of the body 10 and abutted against the concave circular groove 61 of the cover 60 for fixing the cover 60 onto the body 10.

Figure 2:
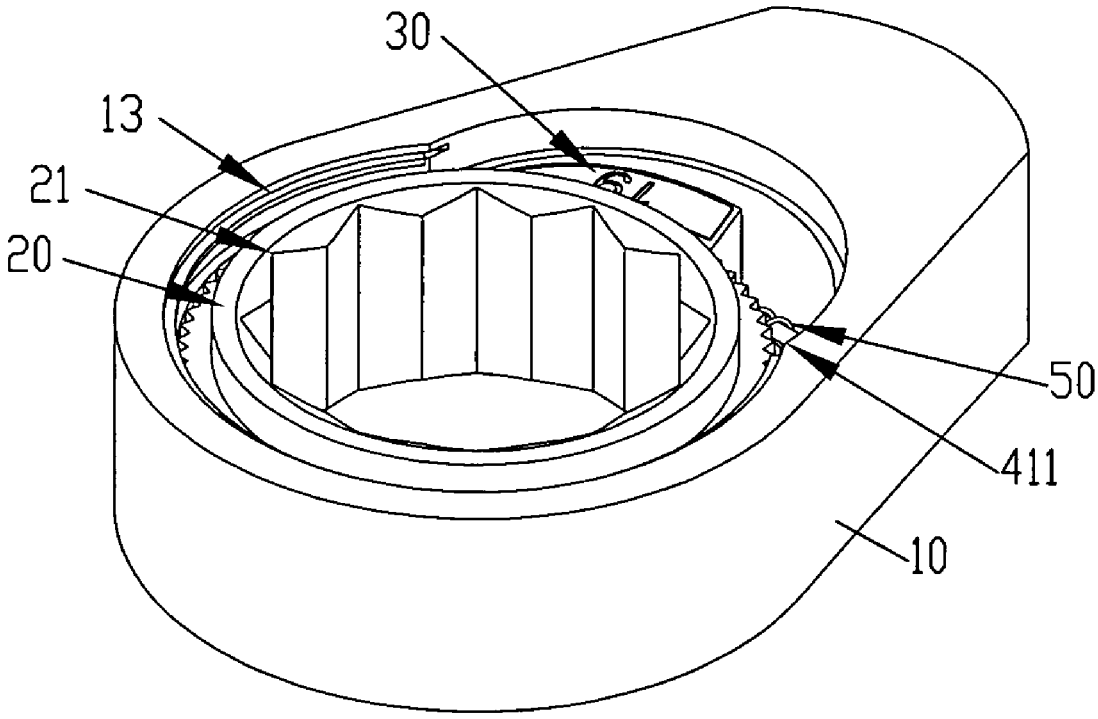
FIG. 2 shows a unidirectional ratchet wrench of the present invention.
Figure 3:
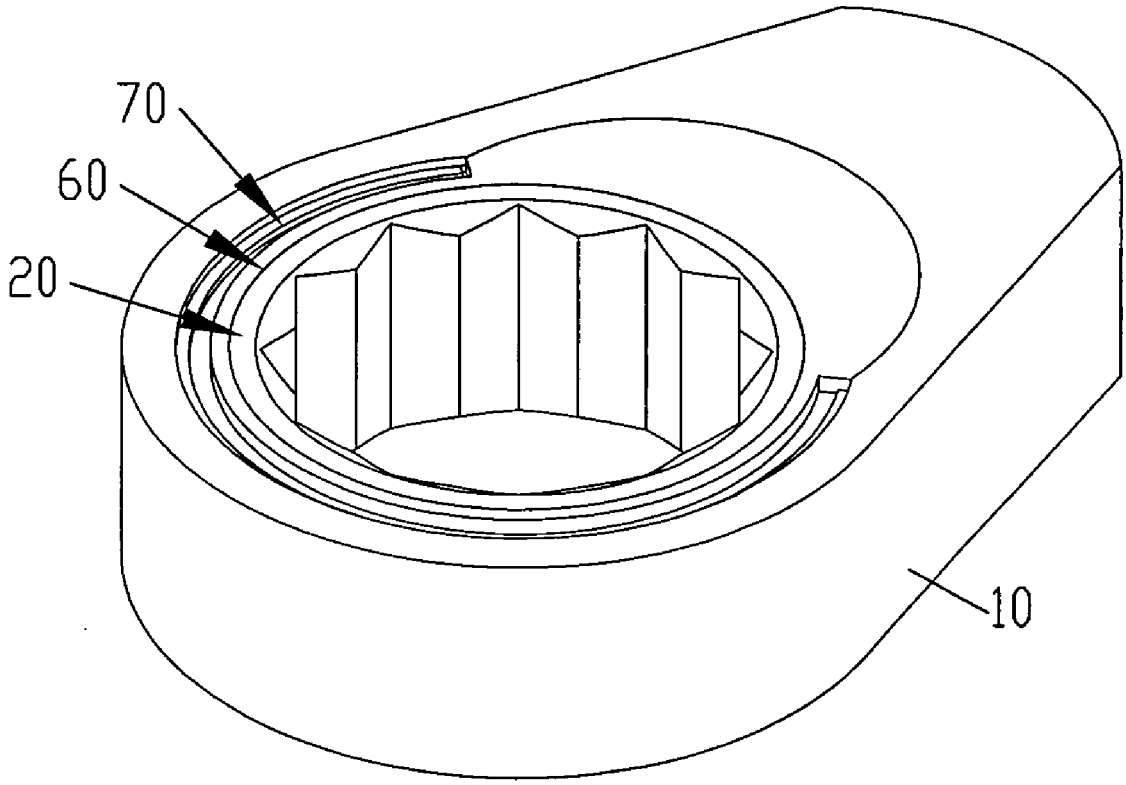
FIG. 3 shows a unidirectional ratchet wrench of the present invention.

In the assembly as shown in FIGS. 2 and 3, the ratchet 20 is contained in the first containing groove 11 of the body 10, and the control plate 40 is installed in the second containing groove 12. the brake tooth 30 is installed in the second containing groove 12. An end of the elastic element 50 is installed in the accommodating groove 32 of the brake tooth 30, and another end of the elastic element 50 is coupled to the horizontal portion 411 of the control plate 40. The bottom surface 300 of the brake tooth 30 is pressed onto a top surface of the control plate 40, and the latch teeth 31 are engaged with the engaging teeth 22 of the ratchet 20. The cover 60 is installed in the upper cover groove 112 of the body 10 for positioning the ratchet 20 and the brake teeth 30 in the body 10, and the latch ring 70 is latched to the circular latch groove 13 of the body 10.

Figure 4:
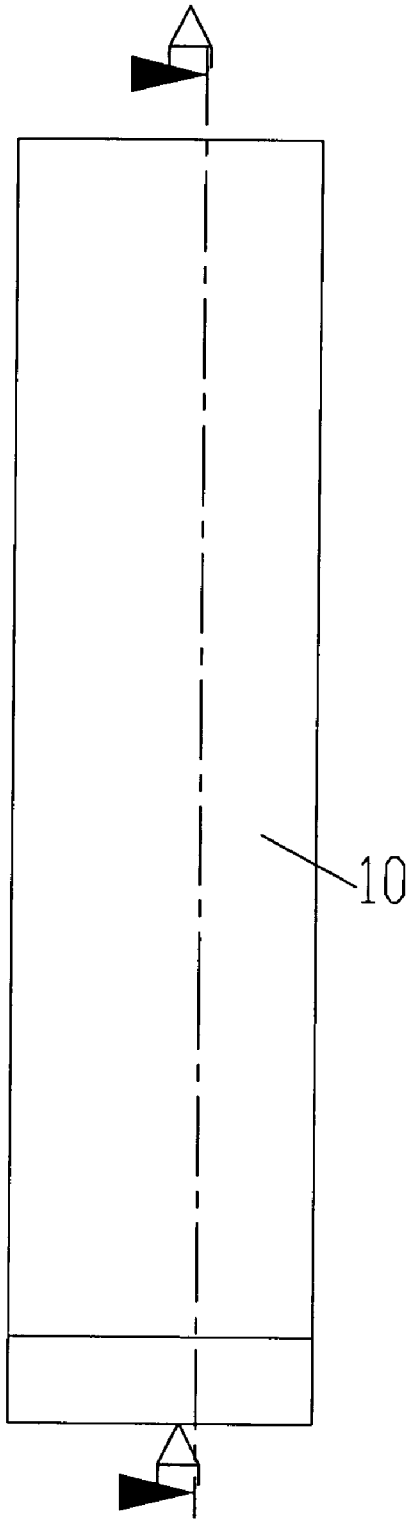
FIG. 4 shows a side view of the present invention.
Figure 5:
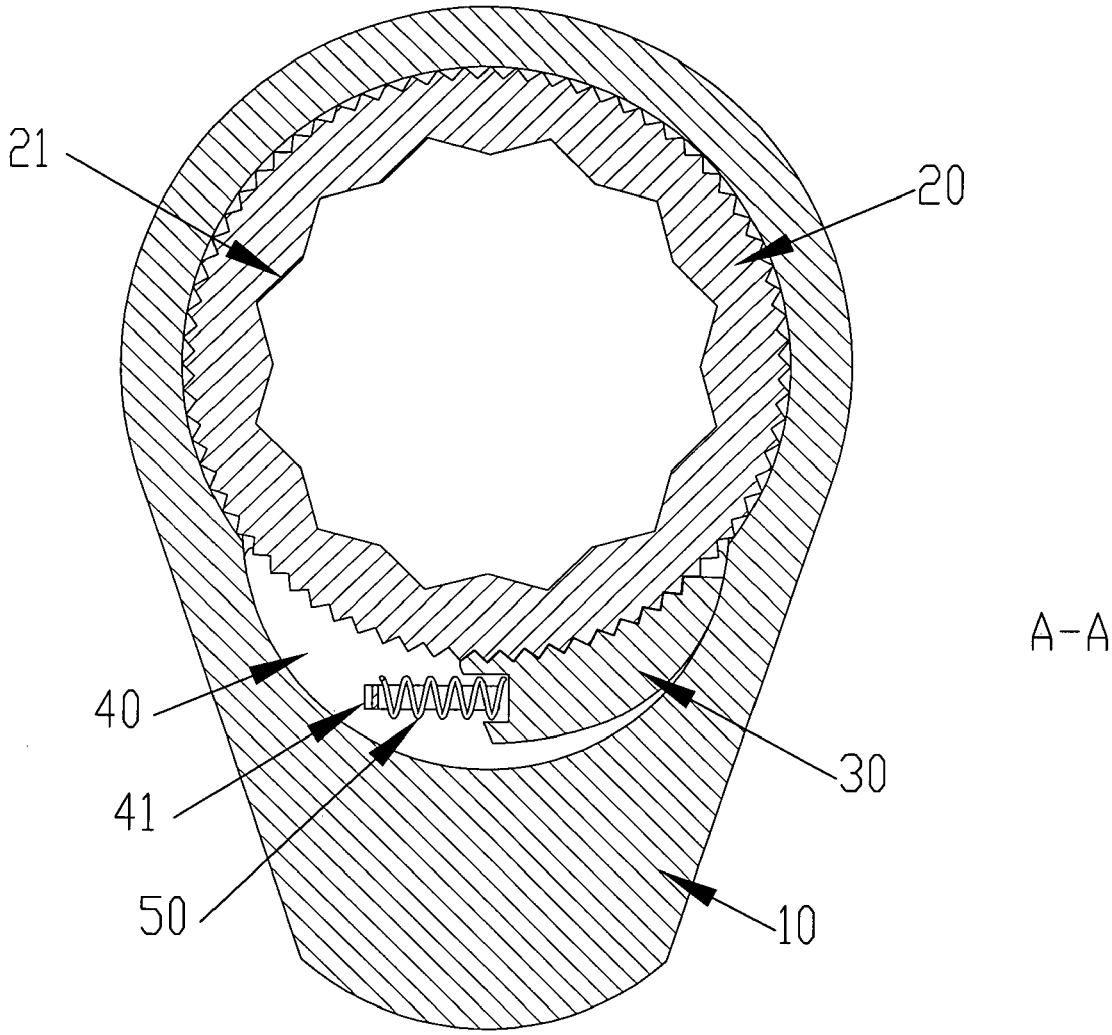
FIG. 5 shows a cross-sectional view of the present invention.

In FIGS. 4 and 5, if the ratchet wrench is turned clockwise, the elastic element 50 resiliently presses against the accommodating groove 32 of the brake tooth 30, such that the latch teeth 31 of the brake tooth 30 are engaged with the engaging teeth 22 of the ratchet 20 in its best engaging condition, and a portion of the brake tooth 30 which is not abutted against the second containing groove 12 is engaged with the engaging teeth 22 of the ratchet 20 to provide the body 10 a unidirectional rotation effect.

Figure 6:
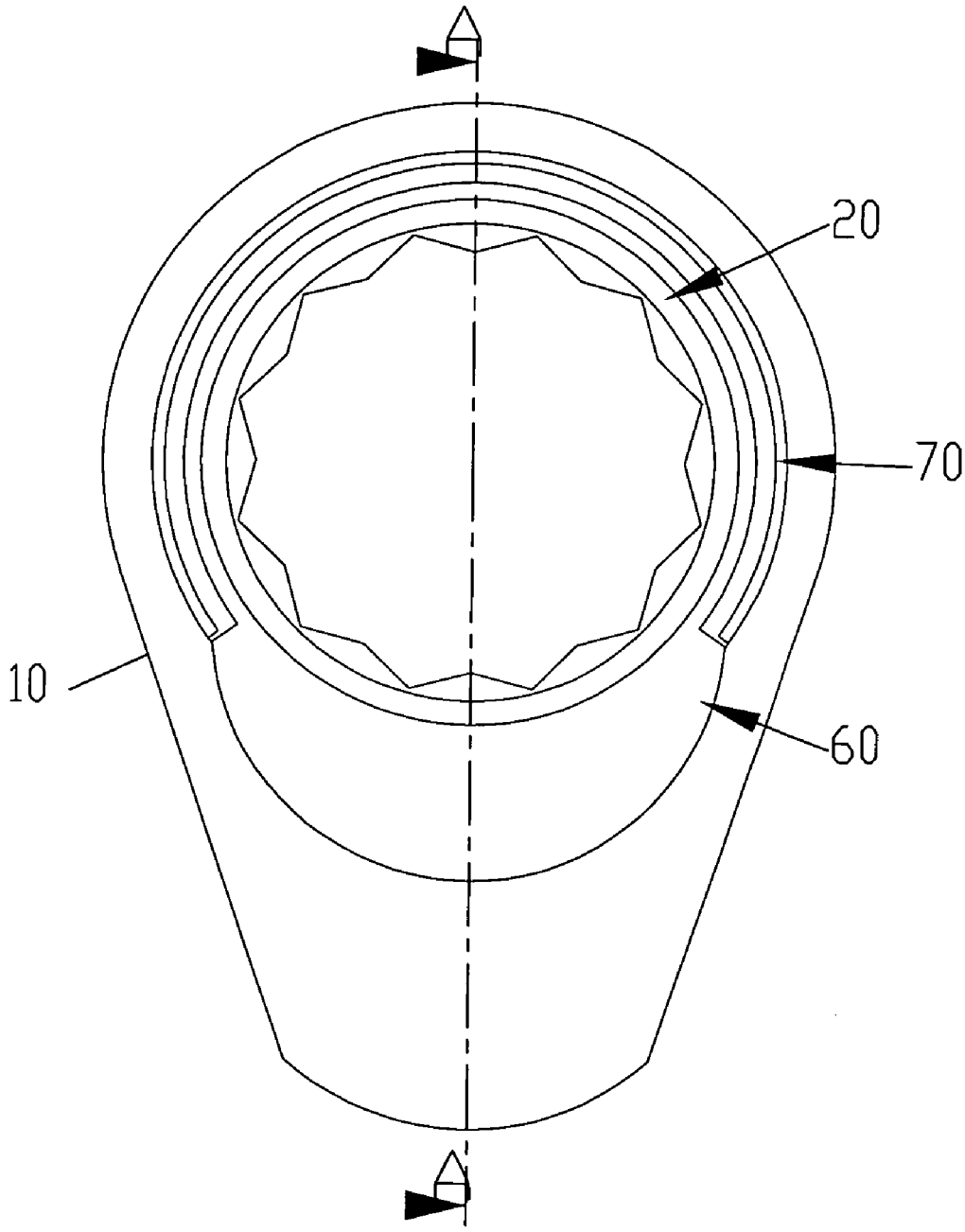
FIG. 6 shows a top view of the present invention.
Figure 7:
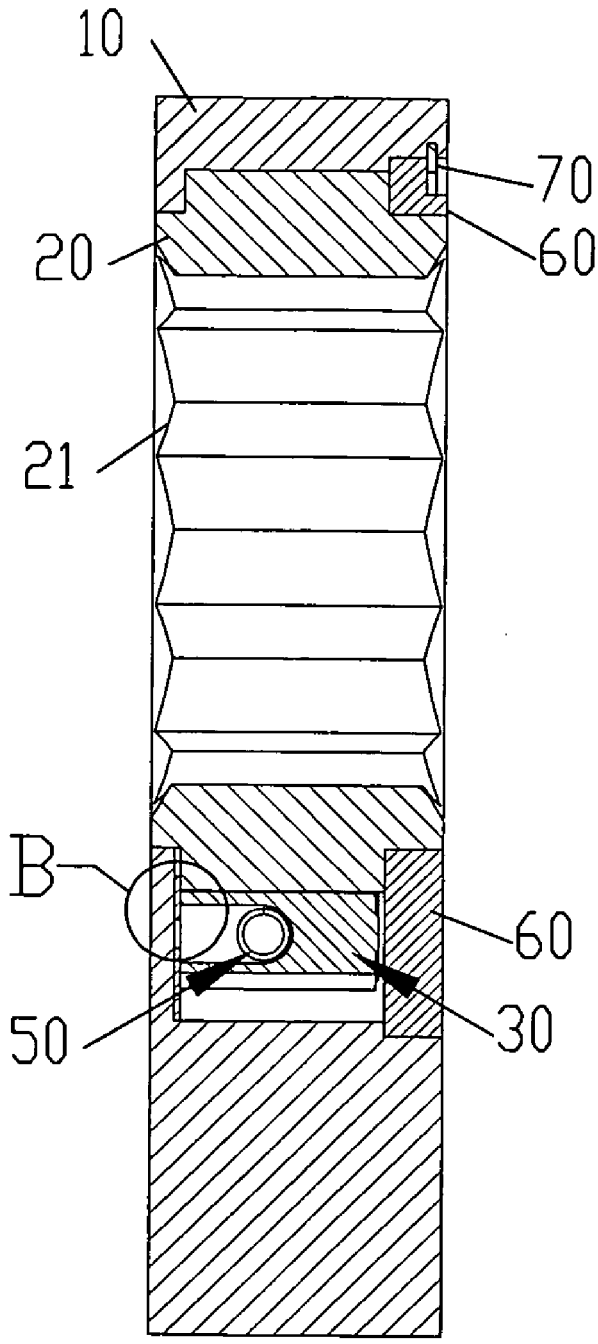
FIG. 7 shows a cross-sectional view of section A-A of the FIG. 6.
Figure 8:
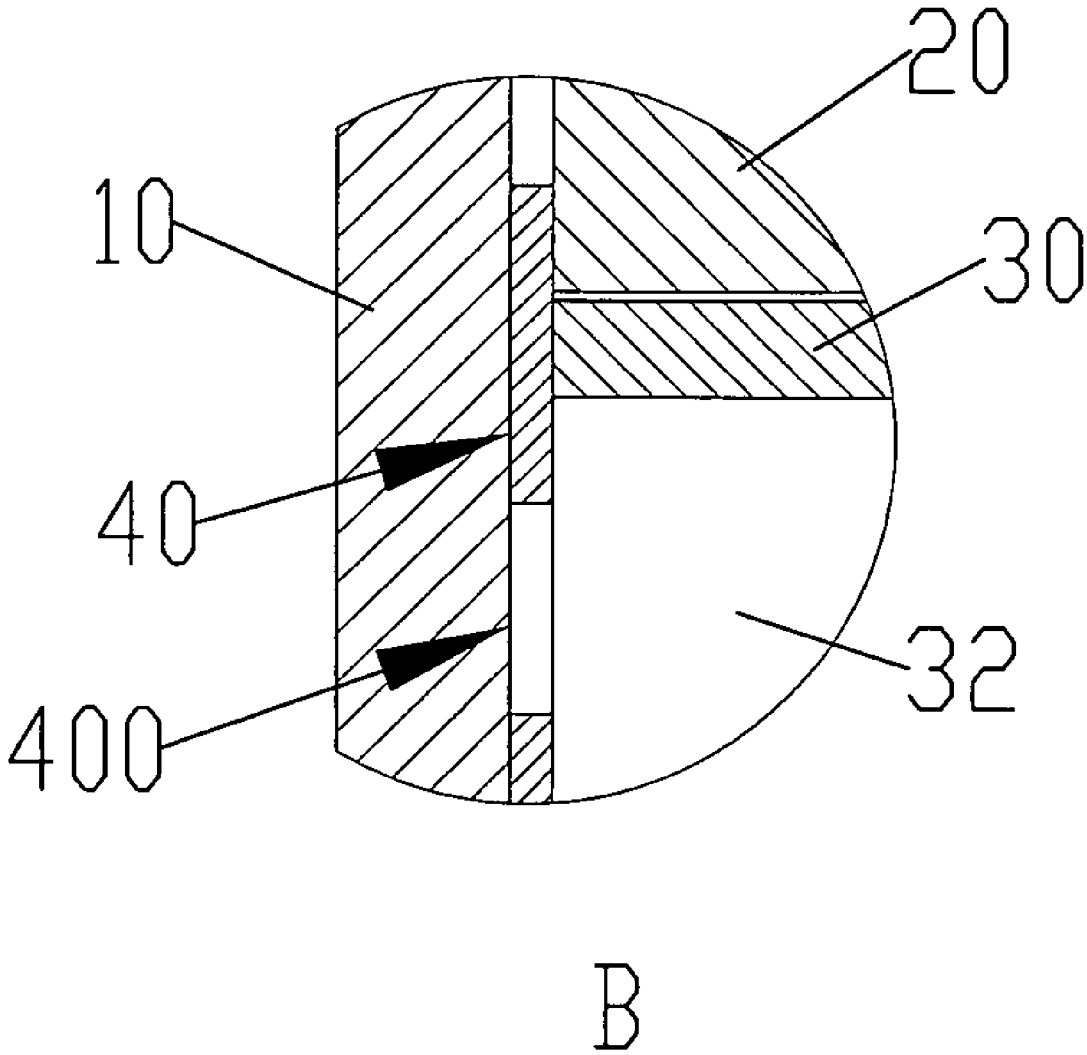
FIG. 8 shows a unidirectional ratchet wrench structure of the B position in FIG. 7.

In FIGS. 6 to 8, there is a height difference between the pressing edge 111 of the body 10 and the bottom surface of the second containing groove 12. In other words, the height of the second containing groove 12 is lower than the height of the pressing edge 111, such that when the control plate 40 is installed in the second containing groove 12, the top surface of the control plate 40 and the pressing edge 111 are situated in a same level. The control plate 40 is pressed by the bottom surface 300 of the brake teeth 30, and a front edge of the control plate 40 is abutted by the engaging teeth 22 of the ratchet 20, such that the front edge of the control plate 40 will rub the engaging teeth 22. The control plate 40 is contained in the second containing groove 12, and the brake teeth 30 at the top of the control plate 40 are engaged with the engaging teeth 22 of the ratchet 20.

Figure 9:
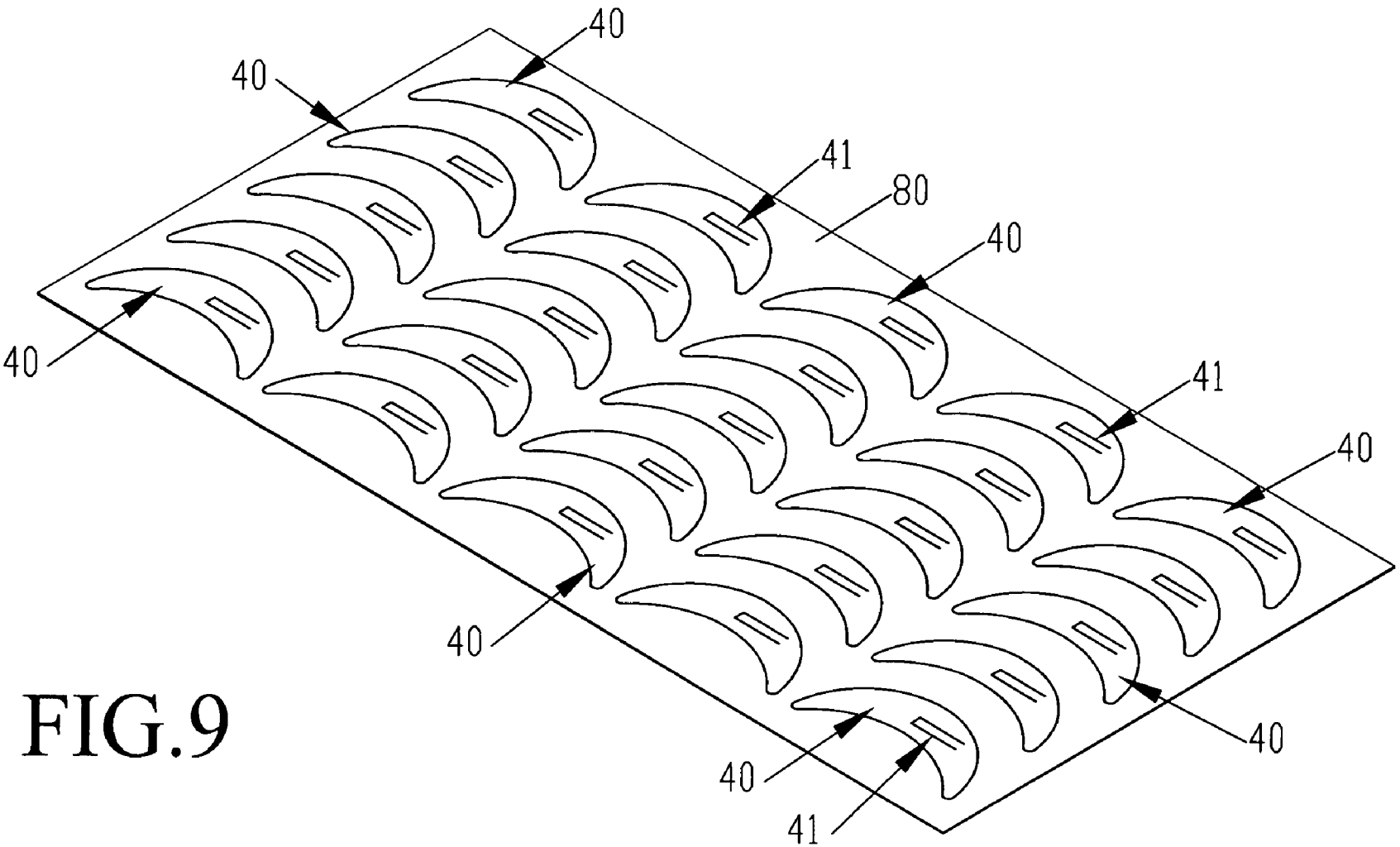
FIG. 9 shows a control plate structure of the present invention.

In FIG. 9, if the control plate 40 is manufactured, a metal plate 80 is pressed by a punch mold and cut by a cutting machine. The metal plate 80 is stamped into a plurality of control plate 40, and the control plates 40 are partially bent into a pressing portion 41 and a horizontal portion 411 which are perpendicular to each other, so that the stamping process just requires two steps, and the manufacture of the control plate 40 which is formed integrally can be more convenient and quicker, and one metal plate 80 can be stamped to produce a plurality of crescent shaped control plates 40.

Figure 10:
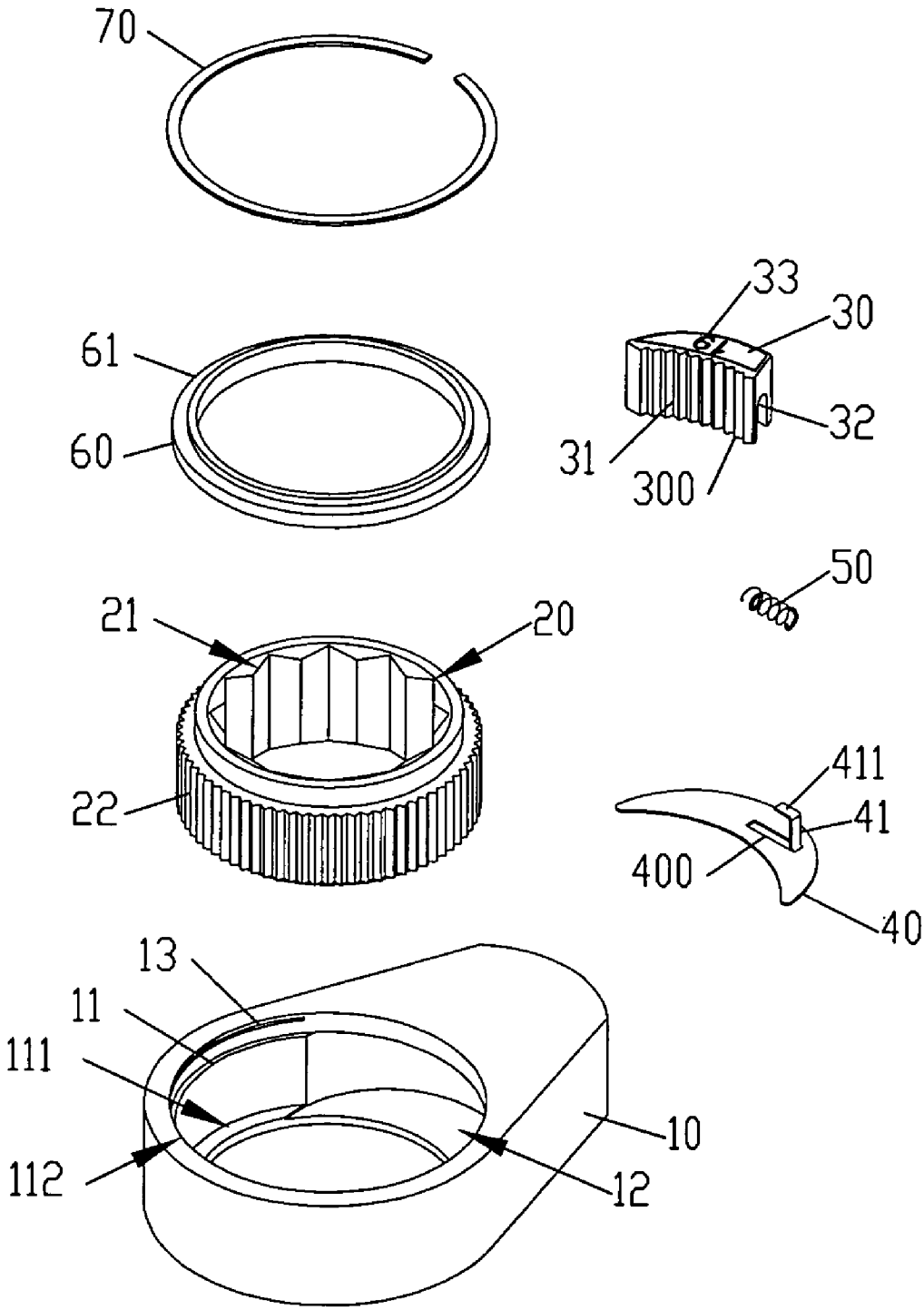
FIG. 10 shows a second preferred embodiment of the present invention.

In FIG. 10, this shows a second embodiment of the unidirectional ratchet wrench in accordance with the present invention. The elements and effects of the second embodiment which are the same with the preferred embodiment are not described, only the differences are described. In this embodiment, the upper cover groove 112 is only located at the first containing groove 11 of the body 10. The cover 60 is coveringly installed in the upper cover groove 112 of the body 10.

Figure 11:
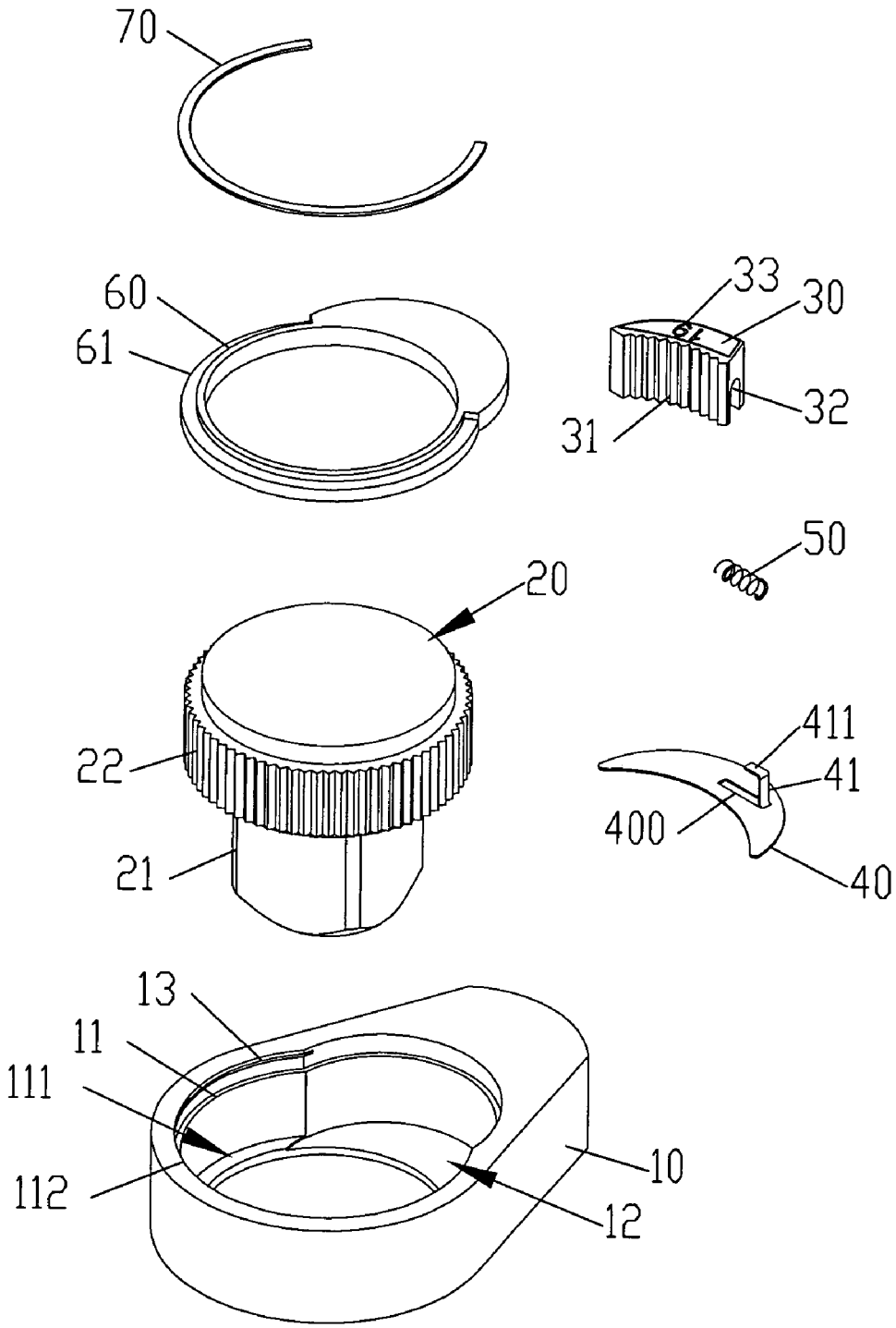
FIG. 11 shows a third preferred embodiment of the present invention.

In FIG. 11, this shows a third embodiment of the unidirectional ratchet wrench in accordance with the present invention. The elements and effects of the second embodiment which are the same with the preferred embodiment are not described, only the differences are described. In this embodiment, the sheathing portion 21 of the ratchet 20 axially extends from the ratchet 20 and is in a tetrahedral shape for engaging and rotating a bushing.

The advantages of the present invention are listed below:

1. The control plate is integrally formed by a sheet metal manufacture, and thus the manufacturing process is relatively simple and easy.
2. After a metal plate is stamped into a plurality of crescent shaped control plates, the cost can be lowered.
3. The accommodating groove has an open shape, and thus the brake tooth can be formed without any additional manufacturing step.
4. The front edge of the control plate will not be engaged or rubbed with the tips of the engaging teeth.
5. The method of connecting the elastic element will not cause a bending or a deformation easily.
6. The latch ring is latched to the circular latch groove and abutted at the concave circular groove of the cover, such that the cover can be taken out by removing the latch ring for a replacement of any component in the body.

What is claimed is:

1. A unidirectional ratchet wrench comprising:

a body including a first containing groove disposed at an action end of the body, a pressing edge disposed on a bottom of the first containing groove and having a smaller inner diameter than the first containing groove, a second containing groove disposed on the action end of the body and in communications with the first containing groove, wherein a bottom of the second containing groove has a relatively lower position than the pressing edge to constitute a height difference, the body having an upper cover groove defined therein, a circular latch groove is disposed on an inner periphery of the upper cover groove;

a ratchet pivotally received in and coupled to the first containing groove of the body and having a sheathing portion formed at a center of the ratchet, the ratchet including a plurality of engaging teeth disposed at an external periphery thereof;

brake teeth contained in the second containing groove of the body and being in an arc shape corresponding to the second containing groove, the brake teeth including a plurality of latch teeth formed on a lateral surface thereof for engaging with the engaging teeth of the ratchet, the brake teeth including an accommodating groove disposed at a bottom surface of the brake teeth, the accommodating groove extending to a lateral side of the brake teeth to form an opening, the brake teeth abutting against a lateral side of the second containing groove, and the brake teeth having a symbol formed on a top thereof for identifying a size;

a control plate contained in the arc second containing groove, and the control plate having the same height as the pressing edge of the body, the control plate made from sheet metal, the control plate having a pressing portion and a horizontal portion integrally formed thereon and configured into an inverted L shape, the pressing portion perpendicularly extending from the control plate, the horizontal portion connected to and perpendicularly extending from the pressing portion, a through slot defined in and extending through the control plate, the through slot adjacent to the pressing portion, and the horizontal portion having the same height as the accommodating groove of the brake teeth, and the control plate installed between the bottom surface of the brake teeth and the second containing groove, and a front end of the control plate is disposed between the engaging teeth of the ratchet and the first containing groove;

an elastic element disposed in the second containing groove, an end of the elastic element contained in the accommodating groove of the brake teeth, and another end of the elastic element installed at the horizontal portion of the control plate, the elastic element is abutted between the brake teeth and the pressing portion of the control plate;

a cover installed in the upper cover groove of the body for positioning each component into the body, and the cover having an L-shaped cross section and including a concave circular groove defined therein; and a latch ring latched to the circular latch groove of the body and abutted against the concave circular latch groove of the cover for fixing the cover onto the body.

2. The unidirectional ratchet wrench as claimed in claim 1, wherein the upper cover groove is located at the first containing groove and the second containing groove.

3. The unidirectional ratchet wrench as claimed in claim 1, wherein the upper cover groove is located at the first containing groove of the body, and the cover is coveringly installed in the upper cover groove of the first containing groove.

4. The unidirectional ratchet wrench as claimed in claim 1, wherein said sheathing portion axially extends from the ratchet and is in a tetrahedral shape adapted to engage with and rotate a bushing.

* * * * *